United States Patent [19]

Krautkremer

[11] Patent Number: 4,838,821

[45] Date of Patent: Jun. 13, 1989

[54] DRIVE MECHANISM PARTICULARLY FOR FLAT-BOTTOMED WATERCRAFTS

[75] Inventor: Franz Krautkremer, Spay, Fed. Rep. of Germany

[73] Assignee: Schottel-Werft Josef Becker GmbH & Co. KG, Spay, Fed. Rep. of Germany

[21] Appl. No.: 241,818

[22] Filed: Sep. 2, 1988

Related U.S. Application Data

[63] Continuation-in-part of Ser. No. 25,112, Mar. 12, 1987, abandoned.

[30] Foreign Application Priority Data

Mar. 18, 1986 [DE] Fed. Rep. of Germany ..... 3609032

[51] Int. Cl.[4] ..... B63H 11/02

[52] U.S. Cl. ..... 440/40; 60/221; 114/151; 440/47

[58] Field of Search ..... 114/151; 440/40, 42, 440/54, 47; 60/221

[56] References Cited

U.S. PATENT DOCUMENTS

| | | | |
|---|---|---|---|
| 2,885,990 | 5/1959 | Hawthorne | 440/54 |
| 3,098,464 | 7/1963 | Holland | 60/221 |
| 3,809,005 | 5/1974 | Rodler, Jr. | 440/40 |
| 4,278,431 | 7/1981 | Krautkremer et al. | 114/151 |

*Primary Examiner*—Sherman D. Basinger

*Attorney, Agent, or Firm*—Flynn, Thiel, Boutell & Tanis

[57] ABSTRACT

A drive mechanism particularly for flat-bottomed watercrafts with at least one centrifugal pump or the like producing a water jet, which pump is arranged closely above the intake opening within the watercraft and within an elbow which is pivotal for controlling the watercraft and the blades or the like of which pump are connected by a ring or the like.

2 Claims, 5 Drawing Sheets

DRIVE MECHANISM PARTICULARLY FOR FLAT-BOTTOMED WATERCRAFTS

This application is a continuation-in-part of U.S. Ser. No. 025 112, filed Mar. 12, 1987 and now abandoned.

FIELD OF THE INVENTION

The invention relates to a drive mechanism, and, more particularly, to a propeller pump or a centrifugal pump the blades of which are connected by a ring encircling the outer ends thereof.

BACKGROUND OF THE INVENTION

Watercraft for shallow waters have small draught and, therefore, are sensitive to weight and displacement changes, in particular if channels or tunnels are provided in the body of the ship for guiding the water of the drive mechanism. Moreover, such crafts are easily maneuverable. What is difficult is that such crafts are much endangered by ground contact.

According to the findings of the inventor it is not sufficient that the drive mechanism be protectively installed, in particular against ground contact. That is, the water sucking task must function even during the least drought of the watercraft. These conditions have the result that the centrifugal pump itself is endangered by dirt sucked in with the water.

It is actually known to provide a filter or screen at the water-intake opening to protect the drive mechanism. Such devices, however, are not perfect. Either the filter or screen have a narrow mesh, then the dirt is more or less satisfactorily kept out, however, the efficiency of the centrifugal pump drops off, in particular if this protective device clogs up. If the mesh is wide, then the efficiency is initially better, however, the dirt is not satisfactorily kept out.

The basic purpose of the invention is to make the centrifugal pump itself insensitive with respect to the dirt, in order to be able to avoid the known protective devices either altogether or to construct them with a wide mesh.

A ring is actually damaging to the efficiency of the centrifugal pump. However, the inventor has observed that the efficiency in the known construction drops off significantly in time. This was due to the fact that stones and the like carried with the water would bend the blades of the centrifugal pump or would damage these in another way, which would influence their function. Because of the ring according to the invention, the rotor of the centrifugal pump keeps its shape and assures a constant conveyance, that is a constant efficiency.

Thus the invention permits a safe arrangement of the centrifugal pump.

Since the drive mechanism according to the invention permits stones or the like to be moved with the water, which stones or the like can influence the quietness of the drive, which in turn can afect the control mechanism, that is the controlling of the swivel motion of the elbow, a driving of the elbow by a motor through a self-locking worm gearing is advantageous.

The above-described entire combination permits a very compact construction, which is achieved with an eccentrically disposed swivel axis of the elbow.

Further advantages and characteristics of the invention can be taken from the following description.

BRIEF DESCRIPTION OF THE DRAWINGS

The invention is described in connection with FIGS. 1 to 3, in which.

DETAILED DESCRIPTION

The figures schematically show the invention. All of the parts which are not needed to be understand the invention, like bearing, seals, etc. have been left out. However, reference to U.S. Pat. No. 4,278,431 is to be incorporated herein.

Centrifugal pumps are in the sense of the invention all pumps with rotating rotors. Elbows are devices, which divert a water jet from one direction into another direction, thus for example also a spiral housing which deflects a stream, which is axial with respect to the pump, into a radial stream.

Figure 1:
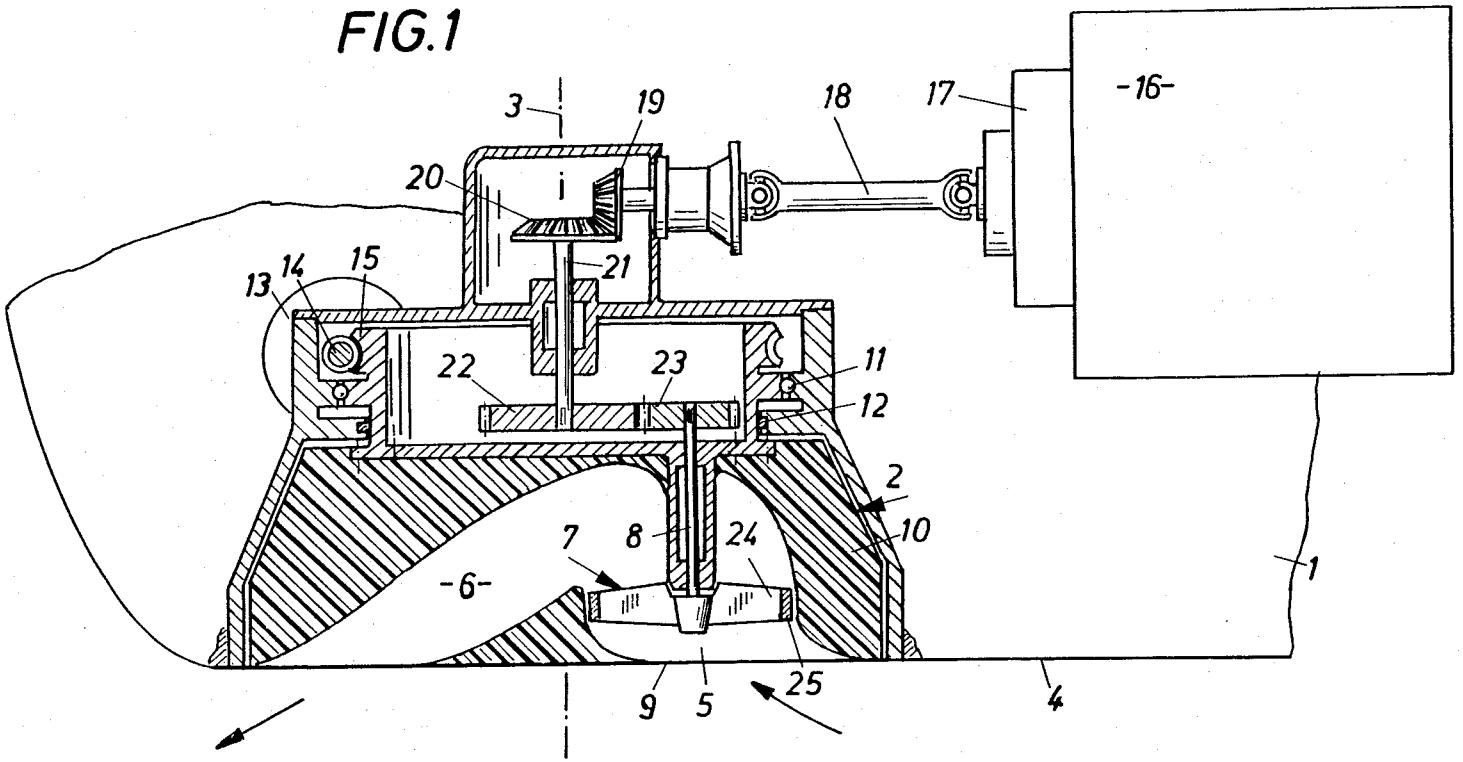
FIG. 1 illustrates an exemplary embodiment of the invention with a propeller pump.

An elbow 2 is pivotally supported about a vertical swivel axis 3 in the hull 1 (FIG. 1) of a flat bottomed watercraft. The elbow consists of an inlet port 5 with an intake opening and an outlet port 6. The outlet port can be constructed as a nozzle. A propeller pump 7 is supported between the inlet port and the outlet port, which propeller pump 7 is secured to the lower end of a pump shaft 8. The pump shaft is arranged eccentrically and parallel with respect to the swivel axis 3 in the elbow 2. The outlet port is directed inclined downwardly, which creates a driving component for the ship. A small fabricated space for the housing 10 of the elbow 2 is created by the eccentricity. The elbow does not project beneath the bottom of the ship 4 or the keel. The propeller of the propeller pump is arranged closely above the intake opening.

The housing 10 of the elbow may consist entirely or partially of a foamable plastic, which creates a tight and very lightweight housing. The bearing of the housing is schematically indicated by the reference numeral 11 and the seals by the reference numeral 12. All known viewpoints for suitable bearings and seals must be considered. The swivel motion of the elbow 2 or of its housing 10 is driven by a control motor 13, which acts onto the elbow through a worm 14 and a worm gear 15. The worm gearing is self-locking. The rotation of the propeller pump 7 is driven by a drive motor 16 which is supported in the hull 1. The drive acts from the drive motor, if necessary, through a coupling 17, a drive shaft 18, a bevel pinion 19 onto a bevel gear 20, connected to a transmission shaft 21, rotatably supported in the swivel axis 3 of the elbow 2. A gear 22 is arranged at the free end of the transmission shaft, which gear 22 mates with a second gear 23, secured to the upper end of the propeller shaft 8. An extremely small diameter of the elbow housing can be achieved with the eccentricity of the propeller shaft. The outer ends of the propeller blades 24 of the propeller pump 7 are connected by a ring 25.

Figure 2:
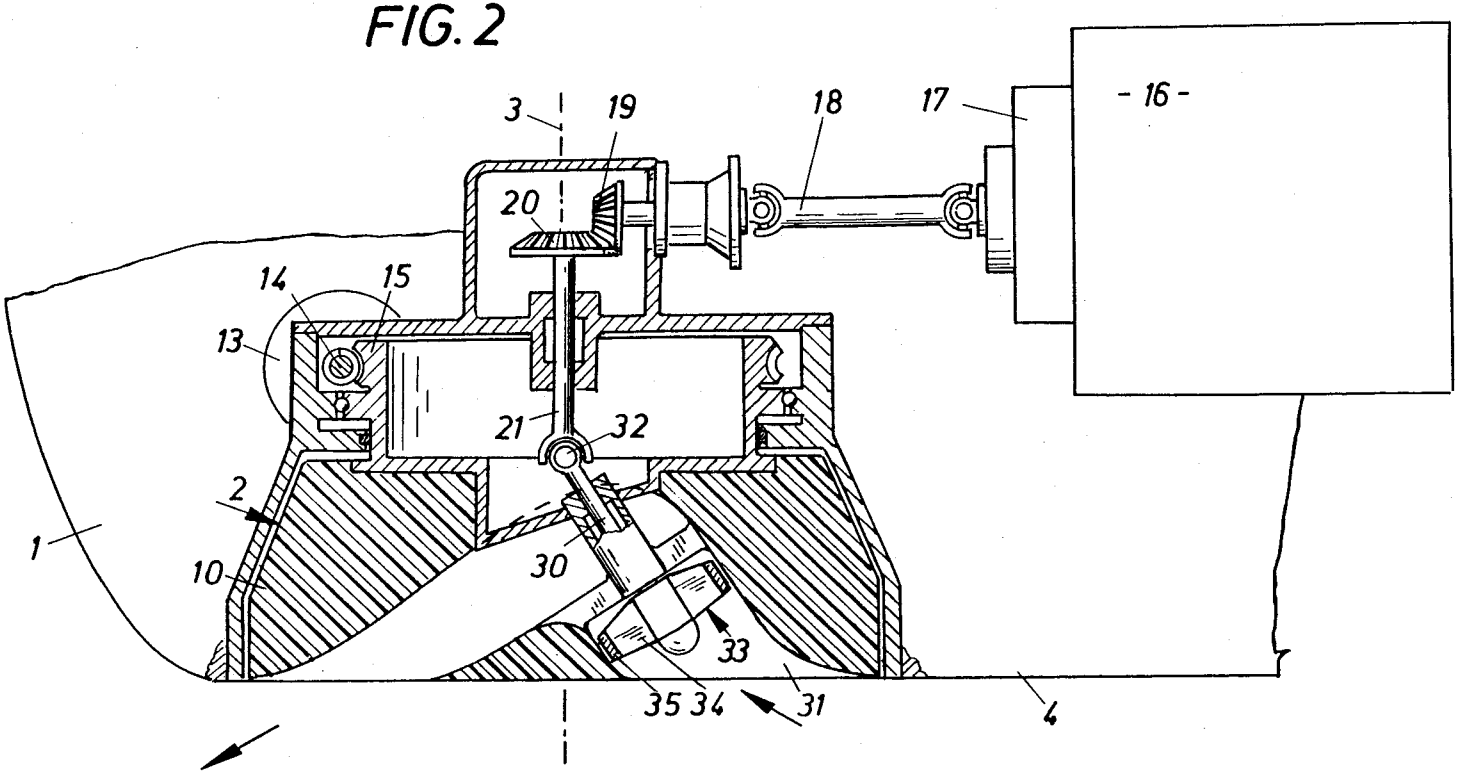
FIG. 2 illustrates a different example with a propeller pump.

FIG. 2 illustrates an exemplary embodiment of the invention in which the pump shaft 30 of the propeller pump 33 and the inlet port 31 are inclined in the intake direction. This results in a smaller intake resistance, especially since the intake opening can be designed hydrodynamically favorably. Furthermore, the suction of the propeller results also in a component in the driving direction. The propeller shaft 30 can be coupled with the transmission shaft 21 by means of a ball-and-socket joint 32 or a bevel gearing or a drive shaft or another suitable element. The torque can also be transmitted by the drive motor 16 driving a pump or a current producer and by arranging an associated hydraulic or electric motor on the propeller shaft 30. This can result in a very advantageous possibility for the distribution of the motor and one or several jet-propulsion devices in the ship. Again the control motor 13 is provided for the swivel motion, which control motor drives the elbow 2 through the self-locking worm gearing 14, 15. The outer ends of the blades 34 of the propeller pump 33 are connected to a ring 35, which gives the blades the desired stability.

Figure 3:
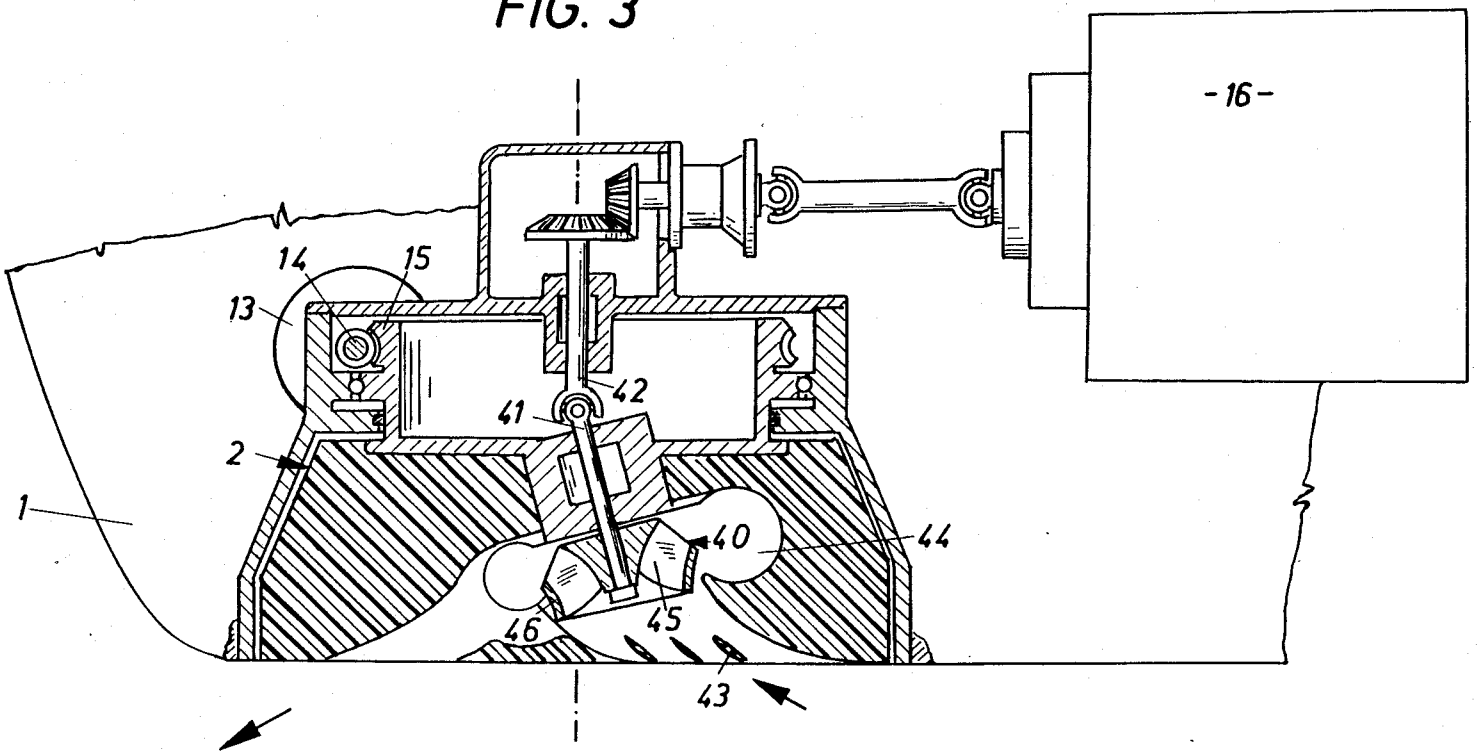
FIG. 3 illustrates an example with a centrifugal pump.
Figure 4:
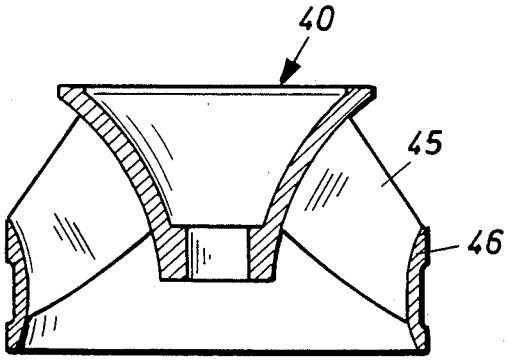
FIG. 4 illustrates as an example a rotor for the centrifugal pump of FIG. 3.

FIG. 3 illustrates an embodiment in which the propeller pump is replaced with a centrifugal pump 40, which with a suitable pump shaft 41 is built into the elbow 2 such that the centrifugal pump lies eccentrically, in this case angularly, to the swivel axis. The centrifugal pump is driven from the drive motor 16 through the above-mentioned gear elements and through the transmission shaft 42, which also differing from FIG. 3 can be inclined slightly in the sense of the propeller shaft, in order to evenly distribute the bend angles of the cardan joints or synchronous joints. The intake opening 9 of the intake port can be provided with nozzles 43 or the like to facilitate an appropriate guiding of the water. The water is sucked in axially from the centrifugal pump and is moved into a spiral housing 44, which ends in the outlet port 6. The outlet port is, like in the preceding examples, arranged inclined such that a forward thrust component results for the ship. Also the inlet port 5 is inclined and, if necessary, curved such that the suction results in a forward thrust component for the ship. As shown in the drawings, the housing 10 of the elbow 2 is, in each embodiment, shaped so that it adapts exactly to the opening provided in the ship and ends flush with the bottom of the ship.

The swivel motion of the elbow 2 can again be driven by the control motor through the self-locking worm gearing 14, 15.

The blades 45 of the centrifugal pump are connected with a ring or the like, which assures the desired blade stability. A "ring" in the sense of the invention includes all structures, which connect the blades and the like, additionally to the hub, with one another and are arranged preferably on the periphery of the centrifugal pump.

Figure 5:
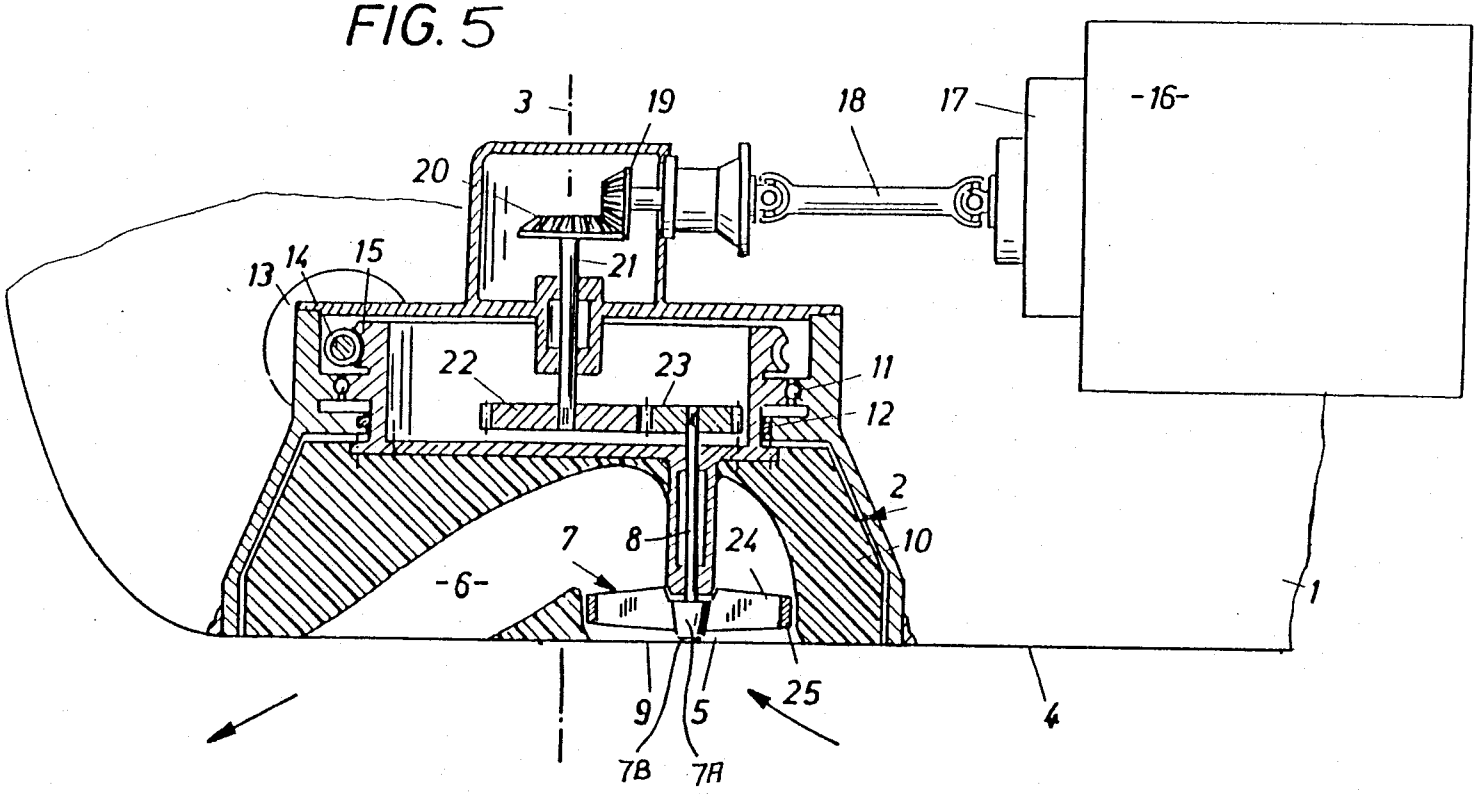
FIG. 5 illustrates yet another example of a propeller pump.

FIG. 5 illustrates a further embodiment which is similar to the embodiment of FIG. 2 and has a propeller pump 7 which is rotated by a vertical axle 8. However, in the embodiment of FIG. 5 the axial end 7B of the hub 7A of the propeller pump 7, which is the lowest point on the propeller pump 7, is substantially vertically aligned with the bottom surface 4 of the ship. This particular position of the propeller pump 7, combined with the provision of the stiffening ring 25, has proved to be particularly advantageous, for the following reasons.

A ship in which the present invention is used is intended for use in extremely shallow water. This means an extremely high possibility that, together with the water, irregularities such as stones, branches and the like will be sucked in by and will damage the propeller. To prevent this, it is a common practice in this sort of ship to use a filter or screen in front of the propeller. The fact that, according to the invention, the blades of the propeller are reinforced by a ring is important because they are no longer liable to get bent by objects in the water, such as branches, stones, and the like. This effectively eliminates the need for a filter or screen. Although the ring diminishes the wheel's degree of effectiveness, there is no real overall loss in performance, because the flow rate would also be reduced by a narrow-meshed filter or screen. Since the filter or screen can be deleted altogether, the wheel may be placed right at the water intake, which is also important for the following reasons.

The suction of water through the guiding passageway at 5 and 6 means losses in energy, especially because of friction between the streaming water and the walls of the passageway. The result of this well known fact is that the passageway is designed to be as short as possible. However, in the conventional arrangement the passageway must be longer than desired in order to provide a portion of the passageway which is upstream of the propeller and which contains the filter or screen. Accoding to the invention, the provision of the stiffening ring on the propeller permits the filter or screen to be eliminated, which in turn permits the portion of the passageway upstream of the propeller to be eliminated (so that the propeller has its most upstream point aligned with the bottom surface of the ship). The elimination of a portion of the passageway permits the passageway to be shorter, which in turn reduces frictional losses therein and increases efficiency.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A hydro-jet propulsion device for driving and controlling shallow draught watercraft, comprising:

hull means;

means defining a downwardly opening recess in a bottom surface of said hull means, said recess having a central vertical axis and an inner surface contour over the entire axial extent thereof which is concentric with said central vertical axis;

elbow means and support means for rotatably supporting said elbow means in said downwardly opening recess and for movement about an axis of rotation which is coaxial with said central vertical axis, said elbow means having a bottom surface which is generally flush with the outer surface of said hull means, said elbow means additionally having a radially outer surface contour conforming to the contour of said inner surface of said downwardly opening recess and being spaced slightly radially inwardly therefrom, said elbow means having means defining a passageway therethrough, said passageway having first and second segments, each of said segments having a longitudinal axis inclined to said axis of rotation of said elbow means, each of said first and second segments opening outwardly of said bottom surface of said elbow means and at locations whereat the central axes of the two openings in said bottom surface of said elbow means are spaced radially outwardly from said axis of rotation of said elbow means; and propeller pump means and drive means therefor, said propeller pump means being mounted in said first segment of said passageway for drawing in water through one of said two openings in said bottom surface and ejecting water from the other of said two openings in said bottom surface, the axis of rotation of a propeller of said propeller pump means being substantially parallel to said axis of rotation of said elbow means, said drive means including means facilitating a drive of said propeller about said axis of rotation thereof, wherein the axially lowest part of said propeller is substantially vertically aligned with said bottom surface of said hull means, and wherein said propeller includes a plurality of angularly spaced blades and includes a stiffening ring which is concentric to said axis of rotation of said propeller and which surrounds and is fixedly connected to said blades.

2. A propulsion device according to claim 1, wherein said propeller includes a hub from which said blades project outwardly, and wherein said axially lowest part of said propeller is at a lower axial end of said hub.

* * * * *